US005572845A

United States Patent [19]

DeSouza

[11] Patent Number: 5,572,845

[45] Date of Patent: Nov. 12, 1996

[54] WOOD RAIL ASSEMBLY AND METHOD OF ASSEMBLING SAME

[75] Inventor: Joseph DeSouza, North Royalton, Ohio

[73] Assignee: Action Sales and Marketing, Inc., Middleburg Heights, Ohio

[21] Appl. No.: 318,184

[22] Filed: Oct. 5, 1994

[51] Int. Cl.[6] ..... E04C 2/12

[52] U.S. Cl. ..... 52/664; 256/24; 256/25; 256/19

[58] Field of Search ..... 52/664, 667, 720.2; 256/24, 25, 21, 22, 19; D25/119, 120, 121, 126; D8/363

[56] References Cited

U.S. PATENT DOCUMENTS

| | | | |
|---|---|---|---|
| 170,850 | 12/1875 | Harding | 52/667 |
| 481,915 | 8/1892 | Norrman | 52/667 |
| 1,445,307 | 2/1923 | Ferris | 256/24 |
| 2,584,690 | 2/1952 | Funck | 256/24 |
| 3,707,276 | 12/1972 | Francis et al. | 256/24 |
| 3,883,120 | 5/1975 | Tippmann | 256/24 |
| 4,112,195 | 9/1978 | Pott et al. | 428/542 |
| 5,301,926 | 4/1994 | Sharp | 256/24 |

FOREIGN PATENT DOCUMENTS

| | | | |
|---|---|---|---|
| 2551637 | 6/1977 | Germany | 256/24 |

*Primary Examiner*—Carl D. Friedman
*Assistant Examiner*—W. Glenn Edwards
*Attorney, Agent, or Firm*—Pearne, Gordon, McCoy & Granger

[57] ABSTRACT

A wood railing assembly for use between vertical posts which may be attached to a wood deck, utilizes top and bottom rails together with a middle rail. The balusters include top, middle and bottom zones having non-circular cross-sections and the middle rail has matching openings. The top and bottom rails have grooves facing the middle rail and a lattice strip is secured to the ends of the balusters and fits within the groove on the rail and suitable fasteners produce a unitary assembly. The assembly is constructed using the middle rail as a template for positioning the balusters on top and bottom lattice strips which then fit within the grooves on the top and bottom rails.

20 Claims, 5 Drawing Sheets

WOOD RAIL ASSEMBLY AND METHOD OF ASSEMBLING SAME

BACKGROUND OF THE INVENTION

This invention relates generally to wood railing systems of the type used around outdoor decks and patios and more particularly to a novel rail assembly having three horizontal rails and the method of assembling it.

Wood railings have been used around wood decks and have also been used as decorative fencing, and in both cases have been mounted between posts that are either attached to the edge of the deck or sunken into the ground. Thus the rail assemblies are usually set up as modular units of 6 or 8 foot lengths that can be either assembled after the posts are mounted in place or pre-assembled as a unit that is then attached to the posts. The latter is not used often because the assembly is difficult to handle and attach to the posts.

Most wood rail assemblies utilize a two rail type of construction having upper and lower rails with the balusters or spindles extending the full distance between them. It has been recognized that the railing can be strengthened and greater decorative arrangements made possible by the addition of a third or intermediate rail. In the latter case, the rail assemblies can employ various decorative arrangements such as those that use intervening spindles that do not extend the full distance between the top and bottom rails, usually terminating a short distance above the middle rail. Such arrangements have required that the bottom and middle rails first be attached to the posts, after which the spindles are inserted downwardly through the assembled rails and then be secured in place. After this has been done for the complete unit between the posts, the top or cap rail is fastened in place.

SUMMARY OF THE INVENTION

According to the preferred embodiments of the present invention, the rail assembly comprises spindles that have rectangular cross-sections at at least the top, bottom and middle zones, and may have other cross-sections of no greater dimension between these zones. The middle rail has enclosed rectangular openings which closely receive the rectangular portions of the spindles and is secured to each of the spindles by a suitable fastener such as a wood screw. The top and bottom ends of each of the spindles has a flat end face that abuts a lattice strip that extends the full length of the assembly. A suitable fastener such as a wood screw or nail extends from the outer side of the lattice strip axially into the spindle to secure the two lattice strips, spindles and the middle rail together as a unit. After these members have been assembled, the top and bottom rails, which are grooved to receive the lattice strips, are secured to the assembly, which can then be attached at each end to the adjacent posts.

The preliminary assembly can utilize a novel process in which the middle rail is first positioned in close contact with one of the top or bottom lattice strips to serve as a template for positioning the spindle ends, which are then secured to the lattice strip by a fastener. After this is done, the middle rail is moved to the others ends of the spindles to serve as a positioning template when the other lattice strip is secured to each of the spindle ends. After both of the lattice strips are fastened to all of the spindles, the middle rail is moved back to its intermediate position and secured in place to each of the spindles. Finally, the top and bottom rails are fastened to the respective lattice strips by placing fasteners such as screws through the lattice strips into bottom and top rails. This way no unsightly fastener heads are visible on the top of the handrail.

Of course, not all of the fasteners need actually be utilized, and if intermediate spindles that do not extend the full distance between the top and bottom rails are used, such as spindles that terminate at a zone between the middle rail and the top rail, this does not affect the assembly method which applies only to the extent that the spindles extend to the adjacent rail.

DETAILED DESCRIPTION OF THE PREFERRED EMBODIMENTS

Figure 1:
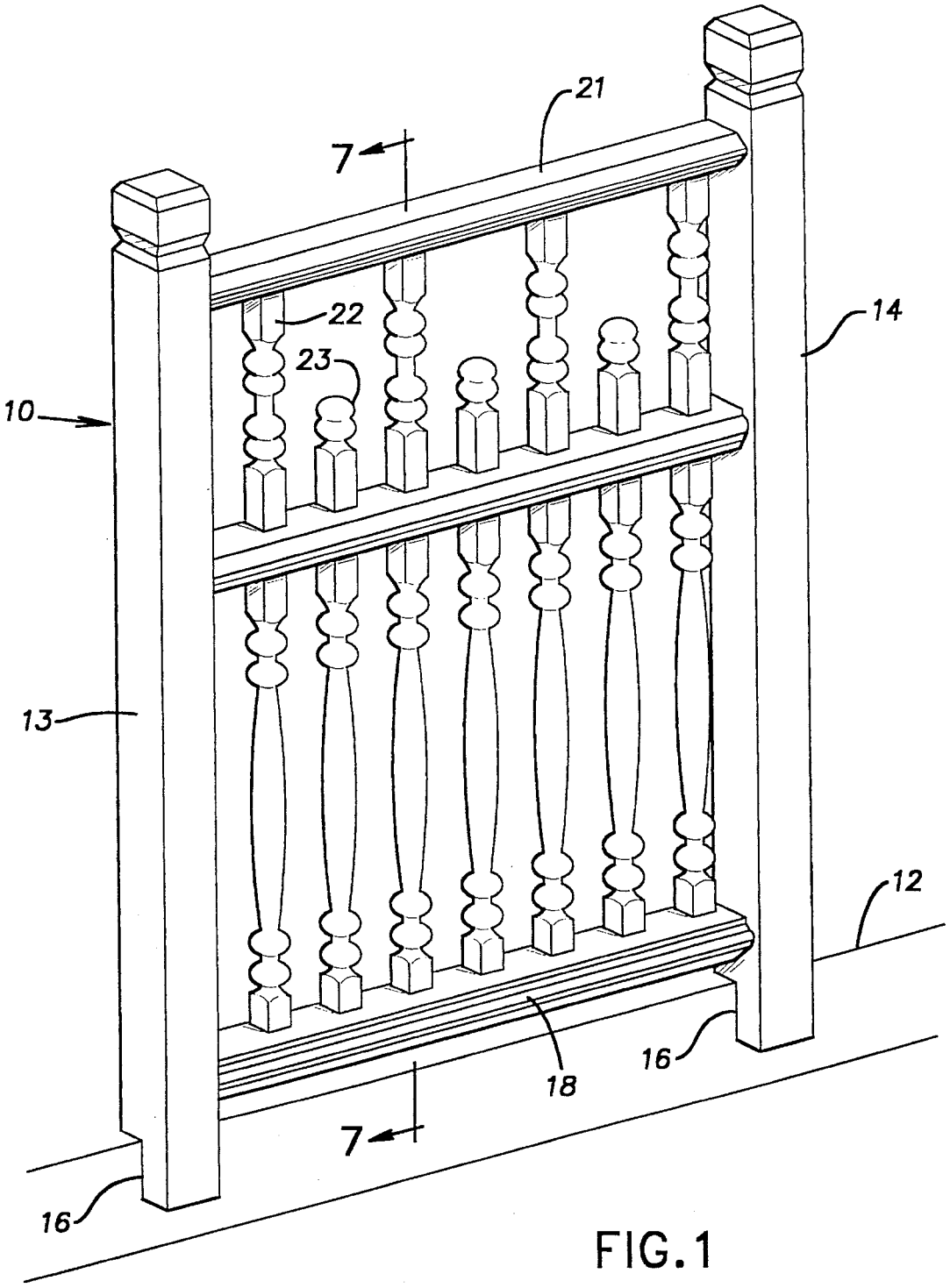
FIG. 1 is a perspective view of a rail unit according to the preferred embodiment shortened in length for purposes of illustration.

Referring to the drawings in greater detail, FIG. 1 shows a rail assembly 10 attached to a typical deck 12. The rail assembly 10 has been shortened for sake of illustration, and generally is modular in arrangement with each section including posts 13 and 14 each of which are provided with notches 16 at the bottom so that they fit over the deck 12 to which they are anchored. It will be understood that the entire rail assembly consists of wooden members together with the metal fasteners holding them together, and generally the deck 12 to which they are applied is also wood, although they could be applied to a brick or concrete patio or deck if that were so desired. It will be understood that the spacing between the post 13 and 14 is such as to place them on nominal centers of, for example, eight feet with the rails being shortened by the thickness of the post and the spindles or balusters are spaced apart a proper distance for safety purposes.

The rail assembly extending between the posts 13 and 14 includes a horizontal extending bottom rail 18 and top rail 21 whose construction will be described in detail later. The vertically extending balusters or spindles may include, for purposes of illustration as shown in FIG. 1, the long spindles 22 interspaced by shorter spindles 23 which do not extend all the way to the top rail 21. Also extending horizontally is the middle rail 25 which extends parallel to the bottom and top rails 18 and 21 but generally closer to the top rail 21 for appearance purposes.

Figure 3:
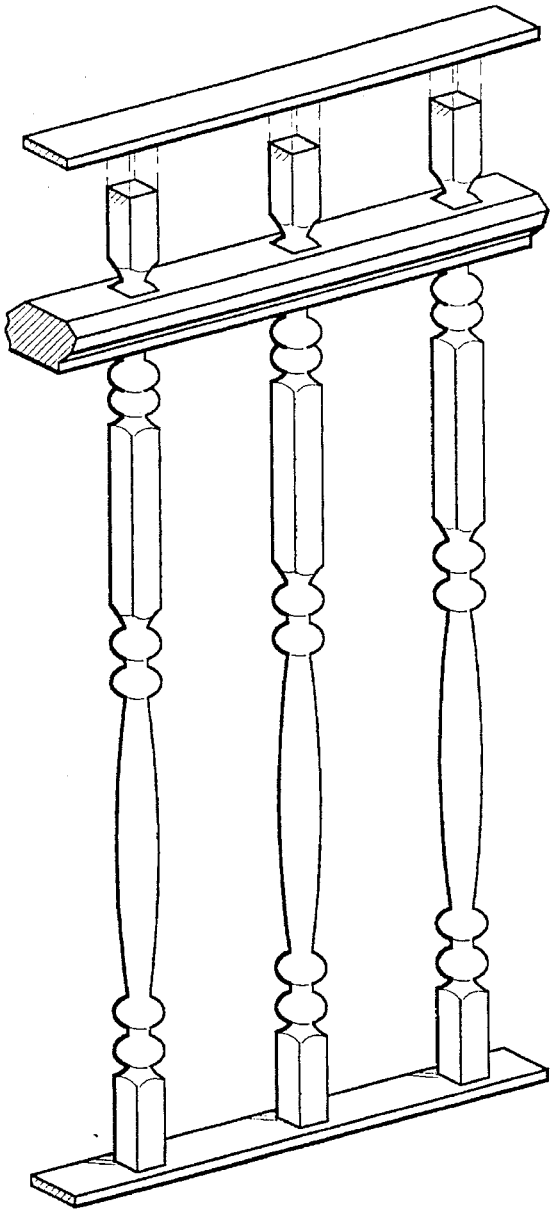
FIG. 3 is a fragmentary view showing the second stage of assembly using the middle rail as a template to locate the spindles with respect to the top lattice strip.
Figure 4:
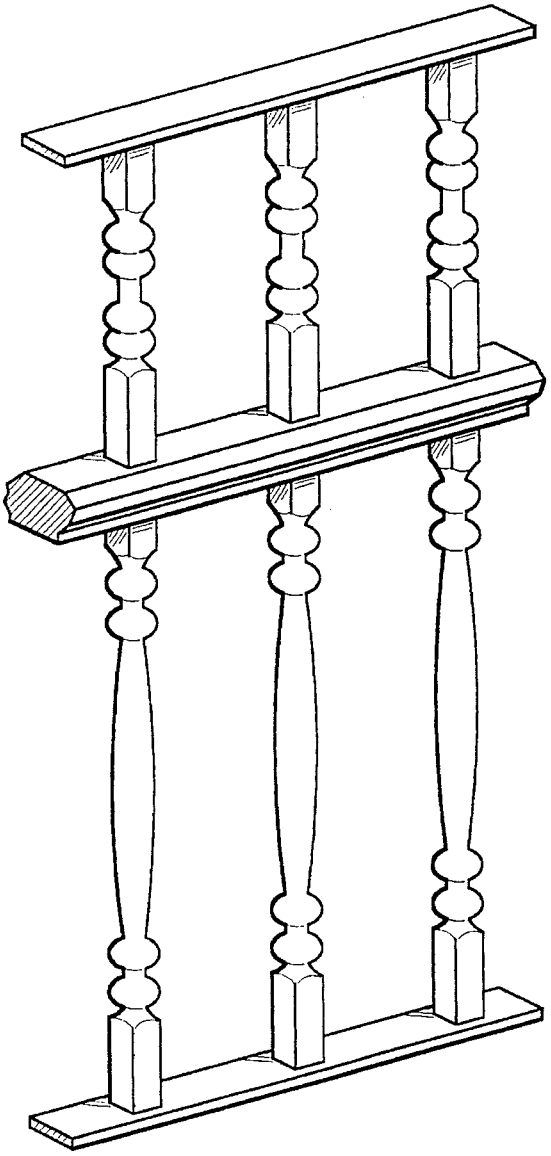
FIG. 4 is a fragmentary view similar to FIGS. 2 and 3 showing the middle rail returned to its final position.
Figure 6:
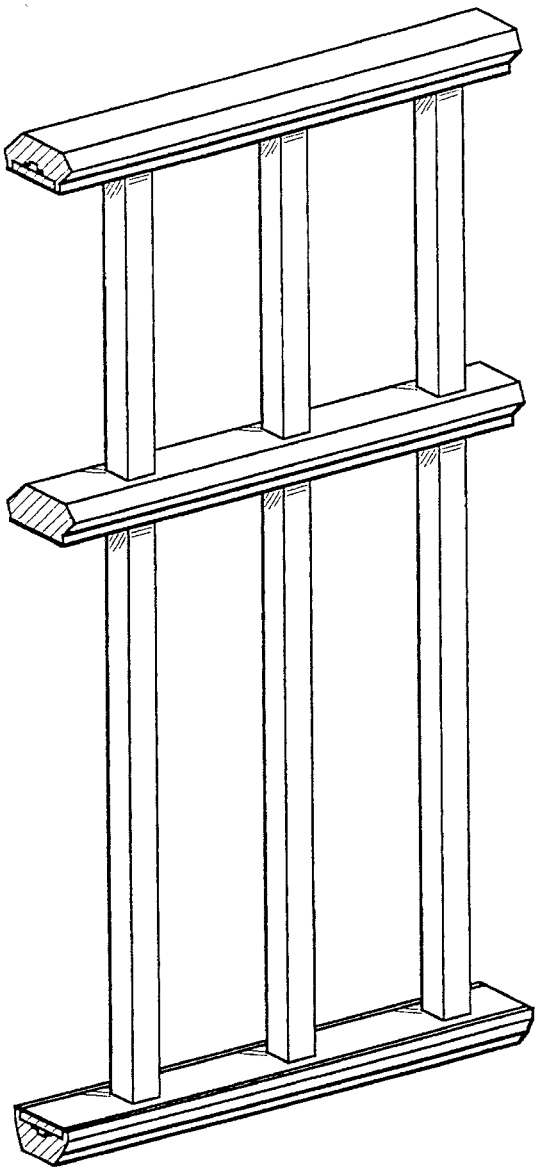
FIG. 6 is a fragmentary view similar to FIG. 5 showing still another spindle embodiment.
Figure 5:
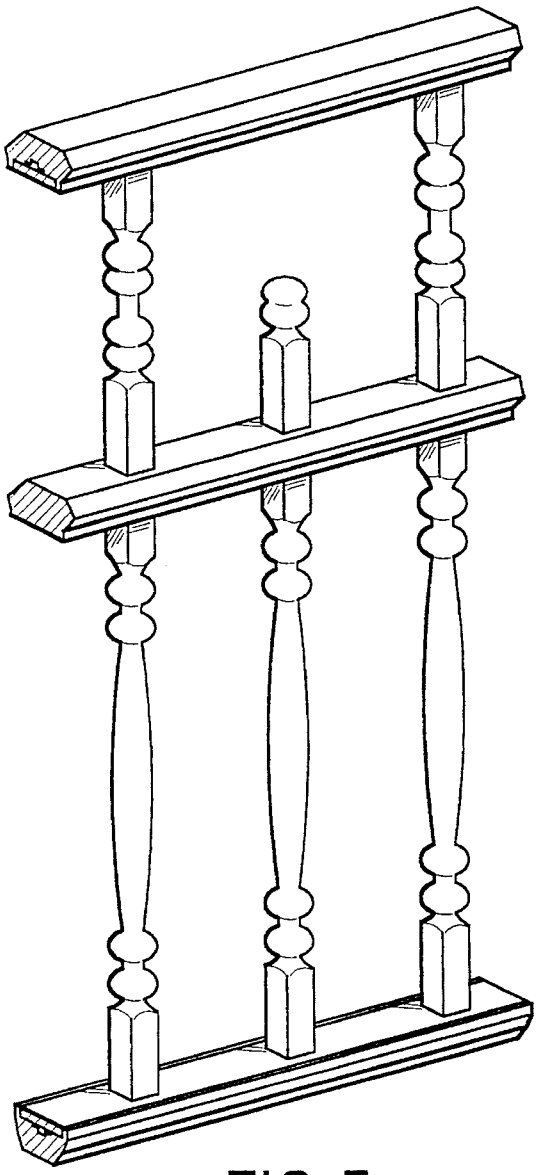
FIG. 5 is a fragmentary view similar to FIG. 4 showing another spindle embodiment with the top and bottom rails attached.
Figure 10:
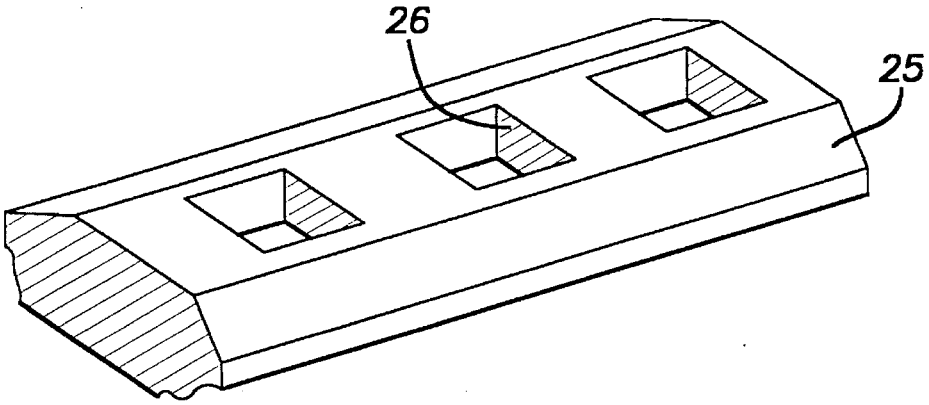
FIG. 10 is a perspective view of a section of the middle rail.
Figure 9:
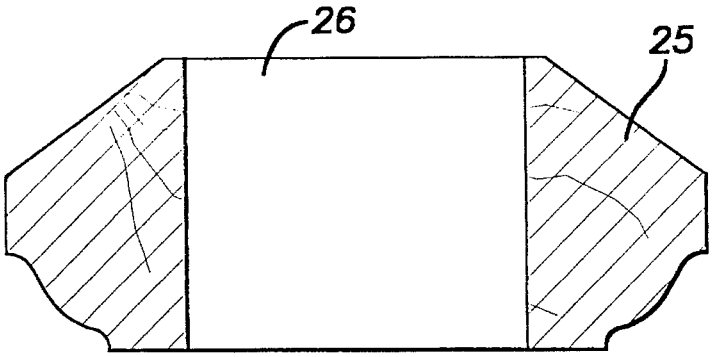
FIG. 9 is a cross section through the middle rail.

Further details of the construction are shown in FIGS. 2–4 and 7 and will be discussed primarily regarding the long spindles 22 which have a top portion 27, bottom portion 28 and middle portion 29 which are either square or rectangular, but in any case these portions are identical in cross-section and may be interspaced by lower and upper turn portions 31 and 32 for decorative purposes. However, if that is not desired the balusters may be a fixed cross-section from top to bottom as shown in FIG. 5. As shown in FIG. 10, the middle rail 25 has a plurality of openings 26 which correspond in shape and dimension with the top, middle and bottom portions 27, 29 and 28 of each baluster to be a fairly snug fit but still loose enough to allow the rail to slide vertically on the balusters.

Figure 7:
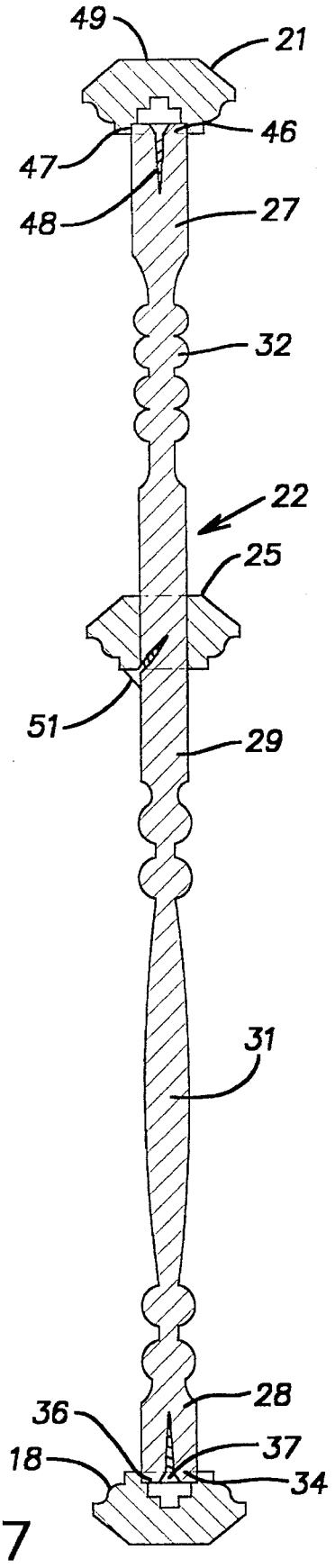
FIG. 7 is a vertical cross section through the rail assembly taken on line 7—7 of FIG. 1.
Figure 8:
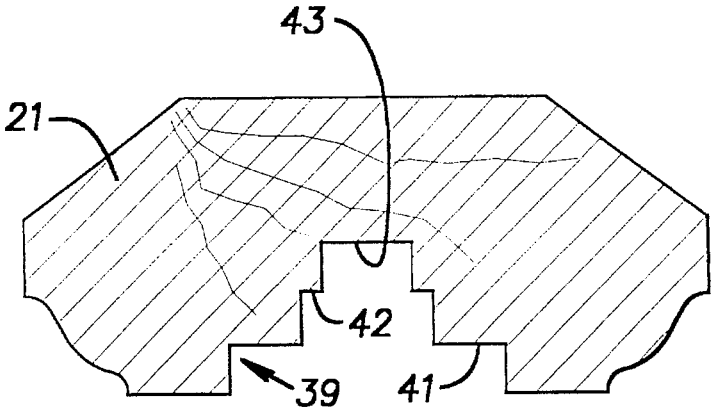
FIG. 8 is a cross section through the top rail.

As shown in greater detail in FIGS. 7 and 8, the bottom and top rails 18 and 21 are identical in cross-section, but the bottom rail is inverted. The spindles each have a flat lower end face 34 extending perpendicular to the longitudinal axis that abuts against a lattice strip 36 to which it is secured by a screw 37. The lattice strip 36 extends the full length of the adjacent rail but is relatively thin and serves to position the spindles as well as close off the rail opening. As best shown in FIG. 8, each rail has a longitudinal stepped groove 39 and is of a universal type designed to receive different spindles or lattice strips as may be desired. In this case, the lattice strip 36 fits within the outer step 41 and the inner step 42 is generally sized to receive spindles directly as an optional construction. The inner groove 43, is basically a clearance groove for screw heads and the like. The construction at the upper end of the balusters is, in effect, the inverse of the lower rail. Accordingly, each of the spindles has a flat upper end face 46 which fits against an upper lattice strip 47 to which it is secured by screw 48. The top rail 21 is then inverted so that the smooth surface 49 is upper most and the grooved surface fits over the upper lattice strip 47. The assembly is then completed by securing the middle rail to the middle portion 29 of the spindles by suitable means such as screw 51. The entire rail assembly is then connected to the post by suitable means such as angled brackets or the like.

Figure 2:
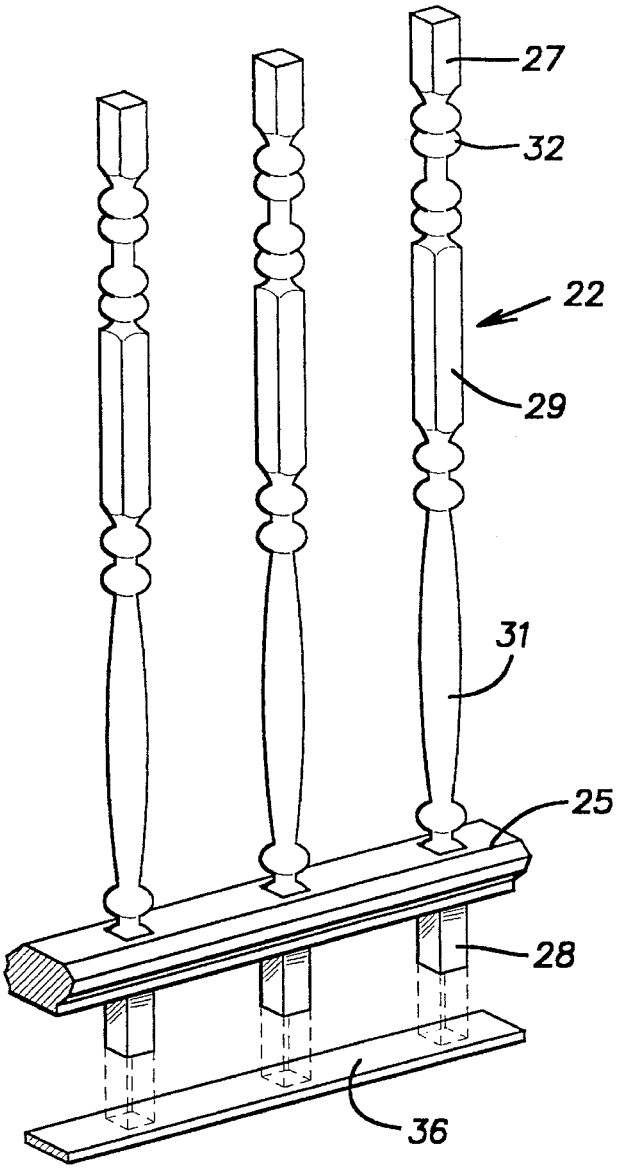
FIG. 2 is a fragmentary view showing the first stage of assembly using the middle rail as a template to locate the spindles with respect to the bottom lattice strip.

The middle rail not only adds stiffening to the assembly it allows the use of short spindles 23 which are therefor able to be secured at a point close to there upper ends, but the use of the middle rail 25 also assists in the assembly or setting up of the rail assembly 10. As best shown in FIGS. 2, 3 and 4, the middle rail also acts as an assembly tool to speed up and simplify the assembly of the various parts. In effect, the middle rail 25 is used as a template and is therefor placed next to the lower lattice strip 36 at the beginning of the assembly operation as shown in FIG. 2. The spindles are then placed into the middle rail openings 26 with their lower ends 34 abutting the last lattice strip, after which the screws 37 are driven into the spindles to hold them to the lattice strip.

The middle rail is then moved to the top ends of the spindles as shown in FIG. 3 to position them when the upper lattice strip 47 is attached to the spindle upper ends 46 by the screws 48. The middle rail is then moved back to the middle position in alignment with the spindle middle portions 29 and fastened in place by the screws 51. After this has been completed the upper and lower rails 21 and 18 are fitted and secured to the upper and lower lattice strips thru the lattice strips into the upper and lower rails, to form a complete assembly for mounting between the posts 13 and 14.

It is considered important that these spindles have the non-circular top, bottom and middle portions 27, 28 and 29, and preferably these will be square or rectangular, although, oval or other non-circular shapes could be used as desired with the rail openings 26 shaped to fit. For example, common shapes of balusters or spindles are either square as nominal 2×2 wood size or sometimes rectangular to have a 2×3 inch shape. By having the top, bottom and middle portions identical in shape, the middle rail can be used as the assembly tool and because the middle portion to which the middle rail is attached is non-circular, it is easily secured in place by a single screw and serves to prevent rotations of the spindles with respect to the rails so that only a single axially positioned screw is needed at each end.

After the rail assembly has been completed, it is ready to be attached to the posts 13 and 14. This can be done in a number of ways such as by using suitable brackets, but the simplest method is to use long wood screws which are angled through the ends of the rails into the posts. When this is done for the middle rail, the result is a stronger construction than when only the upper and lower rails are used. As an alternative arrangement, the middle rail can be cut to a shorter length than the other rails to leave a visible gap between the ends of the middle rail and the adjacent posts.

Although several preferred embodiments of the invention have been shown and described, various modifications and rearrangements may be resorted to without departing from the scope of the invention as defined in the claims.

I claim:

1. A wood railing assembly comprising a plurality of parallel extending wood balusters in a planar array, each of said balusters having top, bottom and middle zones each having identical non-circular cross-sections, parallel top and bottom rails extending the length of the assembly secured to the respective top and bottom zones of each of said balusters, a middle rail extending between and parallel to said top and bottom rails and having non-circular openings each closely receiving each of said baluster middle zones and being secured thereto by a fastener, each of said balusters having a maximum dimension in said zones, and said middle zone having a length greater than the thickness of said middle rail, whereby said middle rail may be secured at any point along the length of said middle zone.

2. A wood railing assembly as set forth in claim 1, wherein said non-circular cross-sections are rectangular.

3. A wood railing assembly as set forth in claim 2, wherein said rectangular cross-sections are square.

4. A wood railing assembly as set forth in claim 1, wherein the portions of each of said balusters between said top and middle zones and between said middle and bottom zones are circular.

5. A wood railing assembly as set forth in claim 1, wherein each of said top and bottom rails has a groove extending the length of the rail and open towards said middle rail and a lattice strip secured in each of said grooves is secured to ends of said balusters.

6. A wood railing assembly as set forth in claim 1, wherein each of said balusters is interspaced by a second set of balusters, each of the balusters of the second set having only bottom and middle non-circular cross-section portions and having an upper end terminating a distance below said top rail.

7. A wood railing assembly as set forth in claim 1, including vertical posts at each end of said railing assembly secured to said assembly at said top and bottom rails.

8. A wood railing assembly as set forth in claim 7, wherein said posts are also secured to said middle rail.

9. A wood railing assembly as set forth in claim 1, wherein said balusters each have a uniform non-circular cross-section from the top portion to the bottom portion.

10. A wood railing assembly as set forth in claim 9, wherein each of said balusters has a square cross-section.

11. The method of assembling a railing section comprising the steps of:

providing a plurality of balusters of equal length and having top, middle and bottom zones of identical non-circular cross-sections, providing a middle rail having openings matching said non-circular cross-sections, providing top and bottom rails, inserting one of said top and bottom zones of said balusters through said middle rail openings, securing one of said top and bottom rails to the ends of each of said balusters adjacent said middle rail, moving said middle rail to the other of said top and bottom zones, securing the other of said top and bottom rails to the ends of each of said balusters adjacent said middle rail, moving said middle rail to said middle zones of said balusters, and fastening said middle rail to each of said balusters at each middle zone.

12. The method of assembling a rail section as set forth in claim 11, including the intermediate steps of first securing said baluster ends to a lattice strip and thereafter securing said lattice strip to the adjacent one of said rails by fasteners thru the lattice strip into said rails so no fasteners are visible on the top or sides of the top rail.

13. The method of assembling a rail section as set forth in claim 11, including the additional steps of securing said rail assembly between spaced vertical posts.

14. The method of assembling a rail section as set forth in claim 11, including the steps of interspacing said balusters with intervening balusters having top ends terminating below said top rail.

15. A wood railing assembly comprising a plurality of parallel extending wood balusters in a planar array, each of said balusters having top, bottom and middle zones, a top end face, and a bottom end face, each of said top, bottom and middle zones having identical non-circular cross-sections, parallel top and bottom rails extending the length of the assembly secured to the respective top and bottom end faces of each of said balusters, and a middle rail extending between and parallel to said top and bottom rails and having non-circular openings each closely receiving each of said baluster middle zones and being secured thereto by a fastener, each of said balusters having a maximum dimension in said zones, and said middle zone having a length greater than the thickness of said middle rail, whereby said middle rail may be secured at any point along the length of said middle zone.

16. A wood railing assembly as set forth in claim 15, wherein each of said top and bottom rails has a groove extending the length of the rail and open towards said middle rail, said top rail groove receiving an upper lattice strip and said groove of said bottom rail receiving a lower lattice strip, said upper lattice strip having said baluster top end face secured thereto and said lower lattice strip having said baluster bottom end face secured thereto.

17. A wood railing assembly as set forth in claim 15, wherein each of said balusters is interspaced by a second set of balusters, each of the balusters of the second set having only bottom and middle non-circular cross-section portions and having an upper end terminating a distance below said top rail.

18. A wood railing assembly as set forth in claim 15, wherein said balusters each have a uniform non-circular cross-section from the top end face to the bottom end face.

19. A wood railing assembly as set forth in claim 16, wherein each of said balusters is interspaced by a second set of balusters, each of the balusters of the second set having only bottom and middle non-circular cross-section portions and having an upper end terminating a distance below said top rail.

20. A wood railing assembly as set forth in claim 16, wherein said balusters each have a uniform non-circular cross-section from the top end face to the bottom end face.

* * * * *